US005927164A

United States Patent [19]

Anderson et al.

[11] Patent Number: 5,927,164

[45] Date of Patent: Jul. 27, 1999

[54] FOLDING KNIFE AND INTERCHANGEABLE BIT SCREWDRIVER

[76] Inventors: Wayne Anderson; Paolo Cassutti, both of 171 Brook Ave., Deer Park, N.Y. 11729

[21] Appl. No.: 08/977,027

[22] Filed: Nov. 24, 1997

Related U.S. Application Data

[63] Continuation of application No. 08/451,398, May 26, 1995, Pat. No. 5,711,194.

[51] Int. Cl.[6] ..... B25B 23/00

[52] U.S. Cl. ..... 81/440; 81/439; 7/118; 7/165

[58] Field of Search ..... 7/118, 165, 168; 81/437–440; 30/123, 151, 164, 155, 161, 152

[56] References Cited

U.S. PATENT DOCUMENTS 1,407,652 2/1922 Hallverson ..... 30/152

*Primary Examiner*—D. S. Meislin

*Attorney, Agent, or Firm*—Lackenbach Siegel Marzullo Aronson & Greenspan, P.C.

[57] ABSTRACT

Folding pocket-style knife and screwdriver having interchangeable bits in which a hinged sleeve folds integrally into the knife handle and unfolds to and locks in 90 and 180 degree angles with the handle to provide angled and straight screwdrivers. The sleeve is a retainer for interchangeable screwdriver bits, retained by ball, C-clip or magnetic retainers.

10 Claims, 5 Drawing Sheets

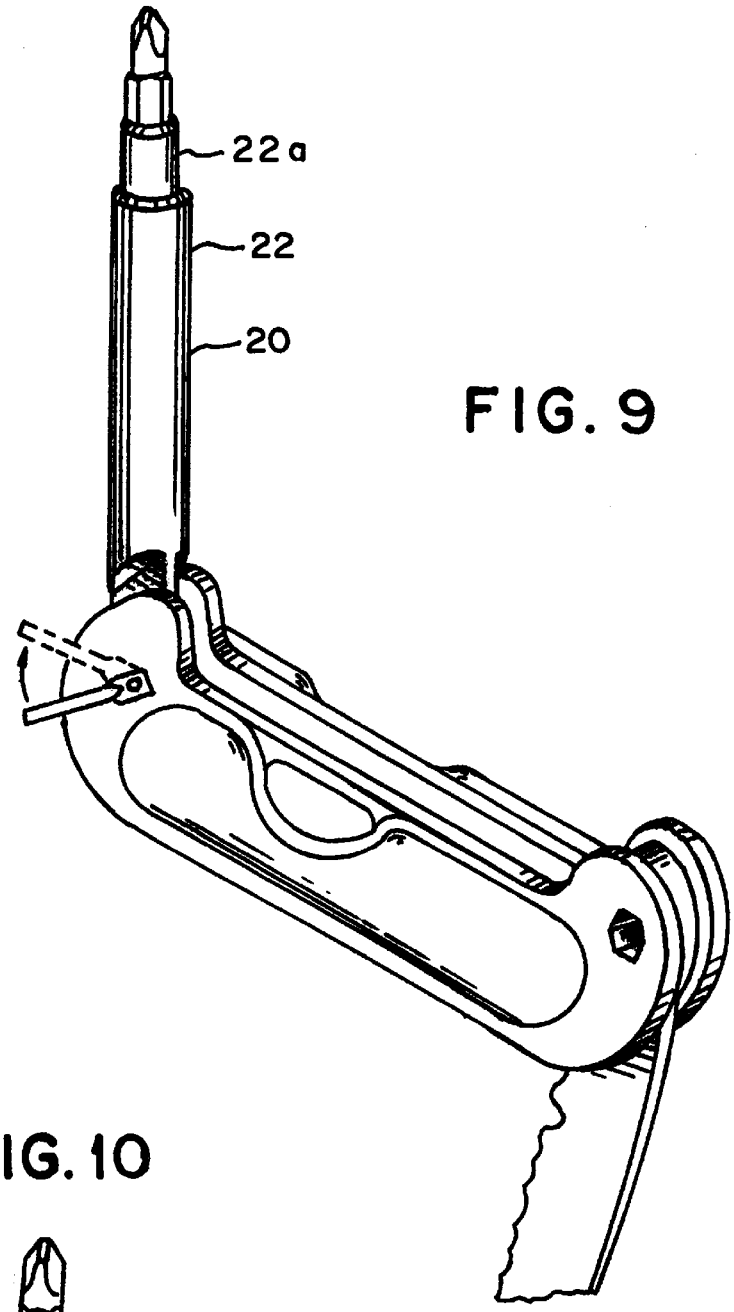
FIG. 9
FIG. 10
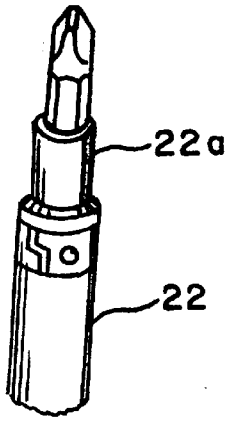
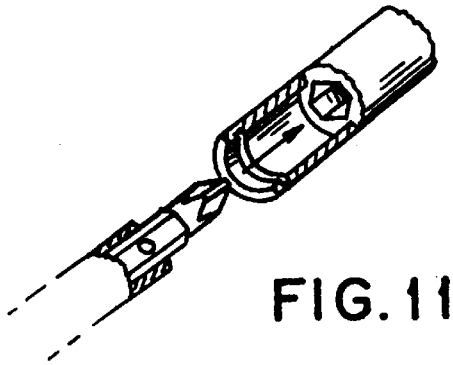
FIG. 11

FOLDING KNIFE AND INTERCHANGEABLE BIT SCREWDRIVER

This is a Rule 60 Continuation of application Ser. No. 08/451,398, filed May 26, 1995 now U.S. Pat. No. 5,711, 194.

BACKGROUND OF THE INVENTION

Incorporation of multiple tool functions or abilities into a single tool device is a well-known convenience as is incorporation of multiple blades and tools which "fold" into a handle in conventional pocket knife configuration. Such blades and tools do not themselves generally fold, but are hinged to the handle and the combination blade and handle are said to fold closed for safe and convenient transport and unfold, or hinge open, for use. In such conventional pocket knife configurations as are known to the applicant, each blade and tool function is represented by a single operative member, such as a knife blade or a screwdriver blade, which are combined in some stacked arrangement to hinge with respect to the handle. On the other hand, multi-purpose tools are known which do not fold, such as interchangeable-bit screwdrivers.

SUMMARY OF THE INVENTION

The present invention provides folding pocket-type knives with the flexibility and functionality of multi-purpose tools. The present invention provides a folding combination pocket-type knife with the professional usefulness of interchangeable-bit screwdrivers and offset screwdrivers using the same interchangeable bit.

In particular, the present invention provides hinged sleeve means which removably retains screwdriver bits in hinged relationship to a handle adapted to receive the sleeve and bit in recessed storage relationship and in exposed functioning relationship. The sleeve means has retaining means which cooperates with the bit to removably secure the bit in the sleeve. The double ended bit is interchangeable with other bits and is reversible, having a different drive at each end.

Also provided is hexagonal cross-hole, extending from one side bolster to the other of the handle, to receive the interchangeable bits in perpendicular relation to the handle, creating an offset interchangeable bit section of the invention. Retractable ball retaining means on each interchangeable bit retains the offset bit by fitting between the side bolsters and being retained thereby.

The folding blades may have provision for locking in open positions for safety to prevent the blades from unexpectedly snapping closed.

DESCRIPTION OF THE DRAWING

In the drawing:

FIG. 9 is a perspective view of the folding knife and interchangeable bit screwdriver of the invention shown in FIG. 6.

FIG. 10 is a fragmentary perspective view of the sleeve-in-sleeve and bit of the folding knife and interchangeable bit screwdriver of the invention.

FIG. 11 is a fragmentary perspective view, partly broken away, of a bit being inserted into the sleeve-in-sleeve of the folding knife and interchangeable bit screwdriver of the invention.

DESCRIPTION OF THE PREFERRED EMBODIMENT

Figure 1:
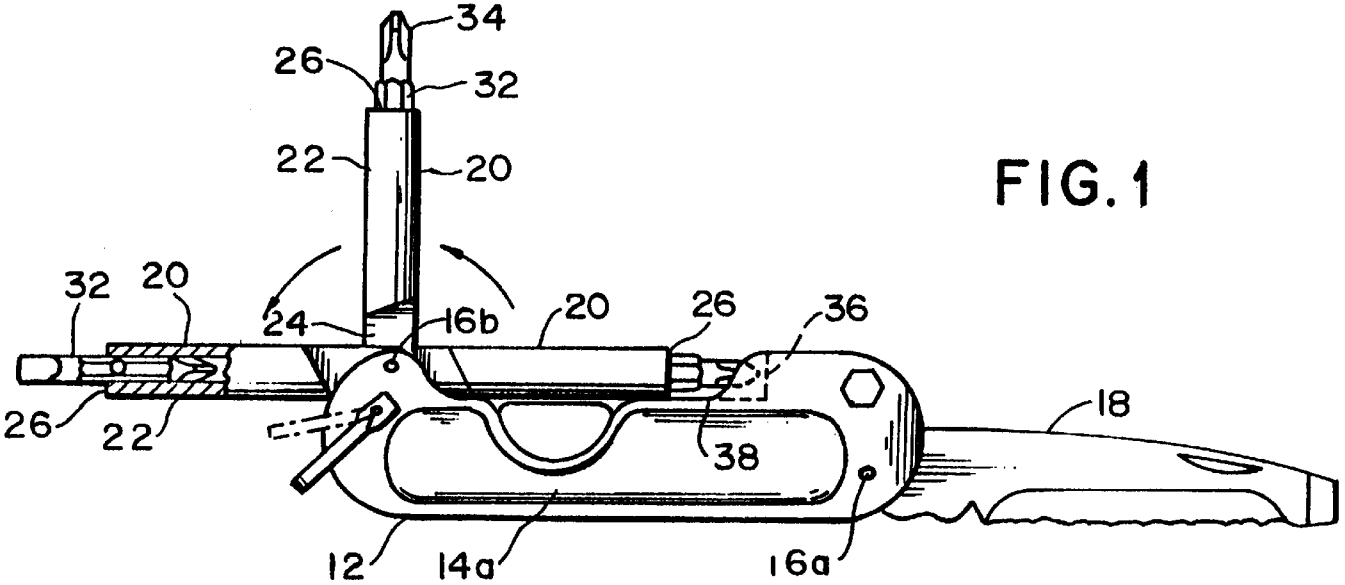
FIG. 1 is a plan view of the folding knife and interchangeable bit screwdriver of the invention showing the sleeve and bit in closed and operative positions and a knife blade in operative position.
Figure 3:
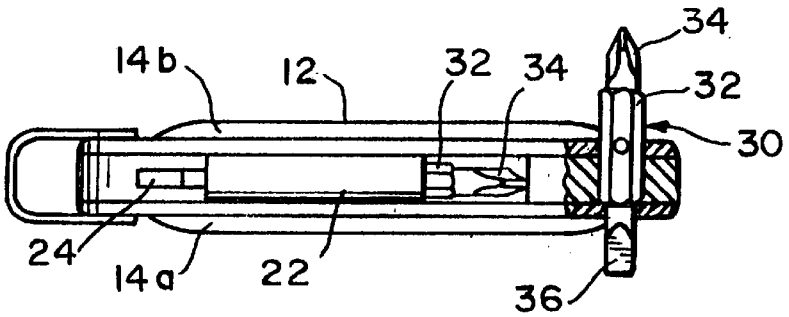
FIG. 3 is a top view of the folding knife and interchangeable bit screwdriver of the invention showing a screwdriver bit in offset position.
Figure 2:
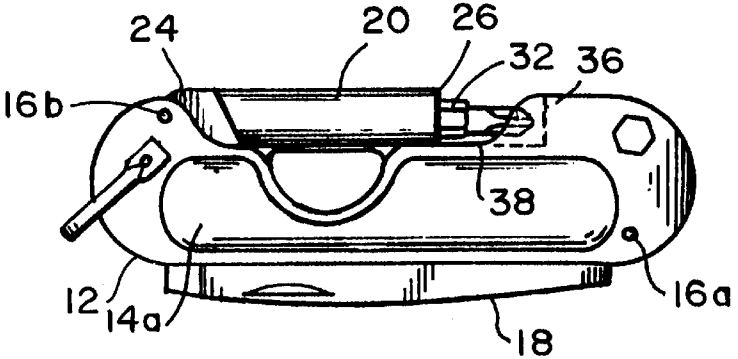
FIG. 2 is a plan view of the folding knife and interchangeable bit screwdriver of the invention as shown in FIG. 1 in closed position.
Figure 4:
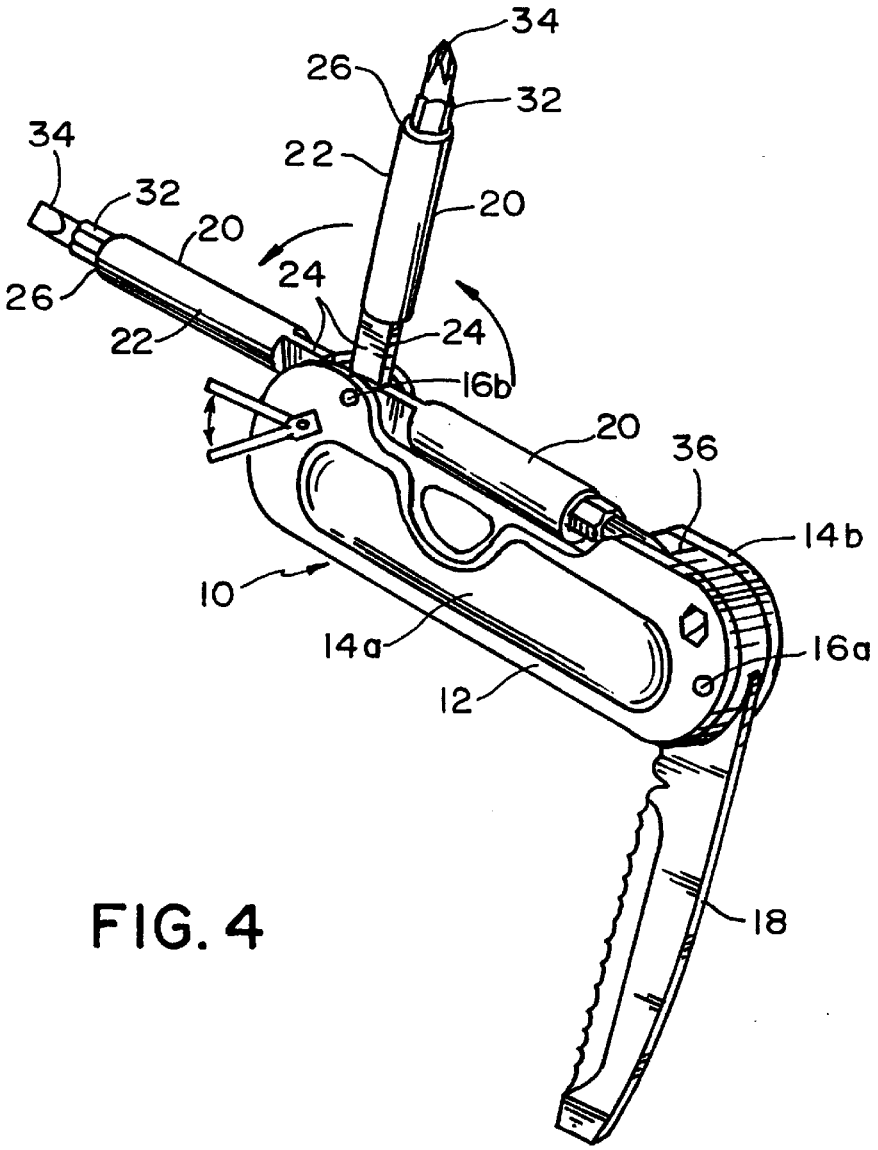
FIG. 4 is a perspective view of the folding knife and interchangeable bit screwdriver of the invention showing the sleeve and bit in closed and operative positions and a knife blade in partially open position.
Figure 5:
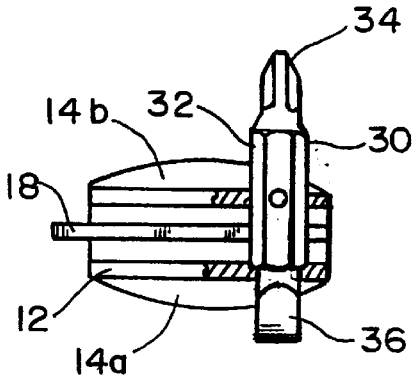
FIG. 5 is an end view of the folding knife and interchangeable bit screwdriver of the invention as shown in FIG. 3.

With reference to the drawing, the folding knife and interchangeable bit screwdriver of the invention 10 comprises handle means 12 having a pair of spaced similarly shaped side bolsters 14*a* and 14*b*. A plurality of hinge pins 16*a* and 16*b* are provided, each traversing between side bolsters 14*a* and 14*b* and perpendicular to the longitudinal axis of handle means 12. In the preferred embodiment, at least one hinge pin is provided at each end of handle means 12. Rotatably attached to one hinge pin 16*a* is a knife blade 18 which swivels about hinge pin 16*a* from a closed position partly or entirely recessed in handle means 12, as shown on FIG. 2, to a partly open position as shown in FIG. 4, to a fully open and operative position as shown in FIG. 1.

Rotatably attached to hinge pin 16*b* is sleeve means 20, comprising hollow tube means 22 having a hinged end 24 and an open end 26 opposite hinged end 24. The interior of hollow tube means 22 is hexagonal in cross-section.

Reversible screwdriver bit 30 comprises a central shoulder section 32 which is non-circular in cross-section, preferably hexagonal, and is adapted to slidably fit within hollow tube means 22. Each end of reversible bit 30 has a screwdriver drive. As shown in the drawing, reversible bit 30 has a Phillips drive end 34 and a crosscut drive end 36, but any combination of useful screwdriver configurations may be used. The screwdriver ends are smaller in cross-section than the cross-section of shoulder section 32 to permit insertion into hollow tube means 22. Reversible bit 30 may be inserted into hollow tube means 22 with either end exposed for use and may be withdrawn and reversed for use of the opposite end. Sleeve means 20 is rotatable about hinge pin 16*b* from an open position, at any angle with respect to the longitudinal axis of handle means 12, or closed wholly or partially within a recess 36 provided in handle means 12 for the purpose.

Figure 6:
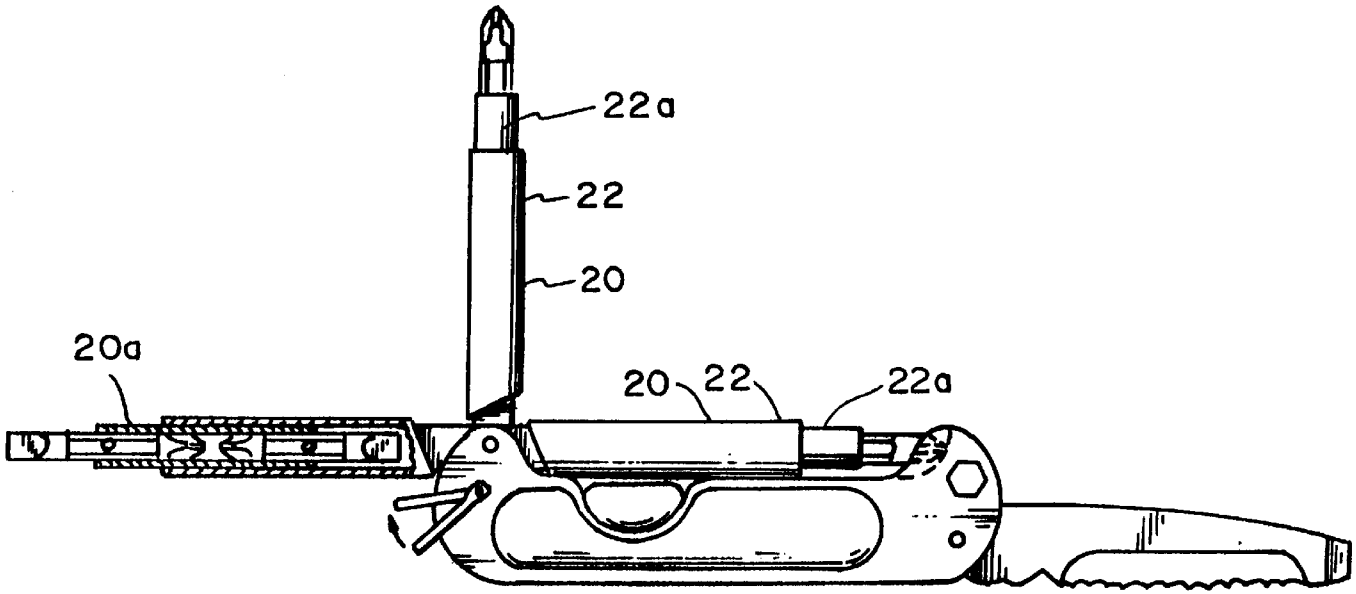
FIG. 6 is a plan view of the folding knife and interchangeable bit screwdriver of the invention showing a sleeve-in-sleeve version of the invention in closed and operative positions and partially broken away to show the internal construction, and a knife blade in operative position.
Figure 8:
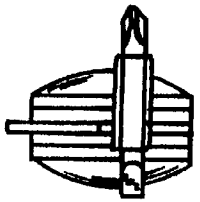
FIG. 8 is an end view of the folding knife and interchangeable bit screwdriver of the invention shown in FIG. 7.
Figure 7:
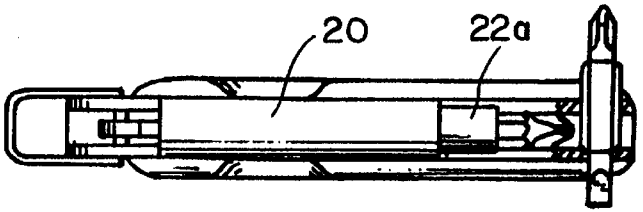
FIG. 7 is a top view of the folding knife and interchangeable bit screwdriver of the invention of FIG. 6, showing the sleeve-in-sleeve and bit in closed position and a bit in offset position.
Figure 12:
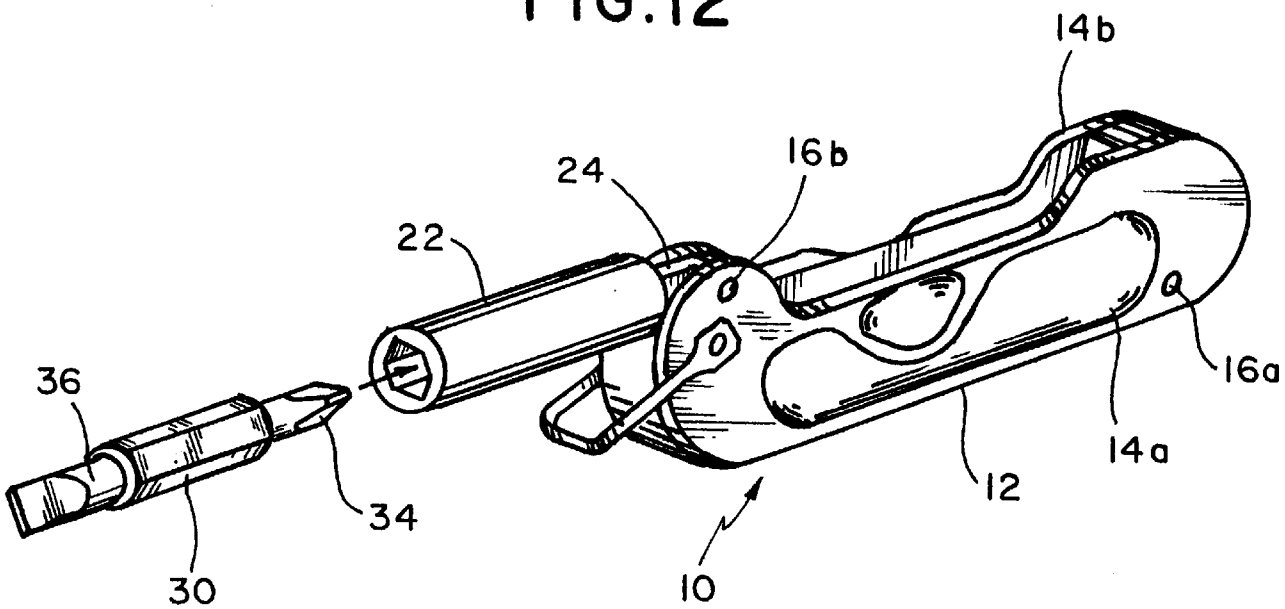
FIG. 12 is a perspective view of a magnetic retainer version of the folding knife and interchangeable bit screwdriver of the invention.
Figure 13:
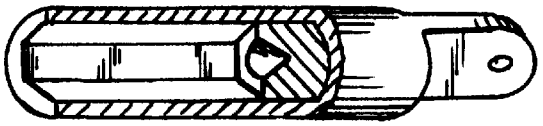
FIG. 13 is a perspective fragmentary view, partly broken away, of the magnetic retainer version of the folding knife and interchangeable bit screwdriver of the invention.

Retaining means are provided on each reversible bit 30 to removably retain each bit in hollow tube means 30. In the preferred embodiment, such retaining means comprise a spring-loaded ball 35. Means such as spring-loaded detents may be provided to retain hollow tube means 30 in closed, 90° open and 180° open positions as shown in FIGS. 1,4 and 6. Reversible bits 30 may also be referred to as interchangeable bit means.

Side bolsters 14*a* and 14*b* are provided with a central depression 38 adapted to receive the users fingers when using knife 18 to help prevent the fingers from sliding onto the knife blade. With appropriate location of hinge pin 16*b* adjacent depression 38, sleeve means 20 may close into depression 38 as well as into recess 36 when closed. Hingedly opening sleeve means 20 exposes depression 38 for use.

With one reversible bit 30, a 2-in-1 folding screwdriver means is provided. The invention also provides a 4-in-1 folding screwdriver means as shown in FIGS. 6–11. Sleeve means 20 is provided with an inner sleeve 22*a* which is slidably secured within hollow tube 22. Means are provided to prevent inner sleeve 22*a* from rotating relative to hollow tube 22, such as by having the exterior of inner sleeve 22*a* hexagonal in cross-section to mate with the hexagonal interior of hollow tube 22. Inner sleeve 22*a* itself has a hexagonal interior adapted to receive and matingly engage shoulder section 32 of reversible bit 30 such that there is no relative rotational motion therebetween. Inner sleeve 22*a* is sufficiently long to receive two reversible bits 30 at the same time, yielding four bit ends for use by reversing either bit in inner sleeve 22*a,* or by reversing inner sleeve 22*a* in hollow tube 22.

What is claimed is:

1. A combination folding tool and screwdriver comprising:

a. handle means;

b. first folding tool means comprising a knife blade, and means for rotating said first folding tool means about 180° from a knife blade closed position within the handle means to an operable position;

c. second folding tool means comprising means for removably holding screwdriver bit means, and means for rotating said second folding tool means about 180° from a closed position within the handle means to an operable position, and screwdriver bit means removably held in the second folding tool means; and said handle means being formed with non-circular cross-hole means for operably receiving said screwdriver bit means.

2. The combination folding tool and screwdriver of claim 1, said handle means being formed with oppositely disposed elongated recesses, and said first and second tool means being disposed in said respective recesses in said respective closed positions.

3. The combination folding tool and screwdriver of claim 1, said cross-hole means being hexagonal and extending through the handle means.

4. The combination folding tool and screwdriver of claim 1, each said means for rotating being in the same direction from the respective closed position to the respective operable position.

5. The combination folding tool and screwdriver of claim 1, said second folding tool means being formed with sleeve means, and said screwdriver bit means having a hexagonal body portion sized for being removably held in said sleeve means, and said non-circular cross-hole means formed in said handle means being hexagonal in shape and sized for slidably holding said screwdriver bit means, whereby said screwdriver bit means is removed from the sleeve means and operably disposed in said non-circular hexagonal cross-hole means.

6. The combination folding tool and screwdriver of claim 5, said hexagonal cross-hole means being a through hole in said handle means.

7. The combination folding tool and screwdriver of claim 1, further comprising a plurality of screwdriver bit means removably held within the second folding tool means.

8. The combination folding tool and screwdriver of claim 1, said screwdriver bit means comprising a non-circular cross section body portion and two screwdriver bits oppositely disposed on said body portion, whereby in the operable position with the screwdriver bit means disposed in the second folding tool means one screwdriver bit is disposed within the second folding tool means and the other screwdriver bit is operably disposed outwardly from the second folding tool means, and with the screwdriver bit means disposed in the cross-hole at least one screwdriver bit is operably outwardly disposed from the handle means.

9. The combination folding tool and screwdriver of claim 1 further comprising screwdriver bit means having a hexagonal body portion sized for being removably held in said sleeve means, and said handle means non-circular cross-hole means being hexagonal cross-hole means sized for slidably operably holding said screwdriver bit means, whereby said screwdriver bit means is removable from the sleeve means and operably disposable in said cross-hole means.

10. The combination folding tool and screwdriver of claim 9, said screwdriver bit means comprising two screwdriver bits oppositely disposed on said hexagonal body portion.

* * * * *